United States Patent [19]

Kaelber

[11] 4,311,016

[45] Jan. 19, 1982

[54] SUPPORTING DEVICE

[75] Inventor: Günter Kaelber, Birmenstorf, Switzerland

[73] Assignee: BBC Brown Boveri & Company, Limited, Baden, Switzerland

[21] Appl. No.: 85,737

[22] Filed: Oct. 17, 1979

[30] Foreign Application Priority Data

Oct. 30, 1978 [CH] Switzerland ..... 200270/78

[51] Int. Cl.[3] ..... F01B 31/06

[52] U.S. Cl. ..... 60/687; 60/692

[58] Field of Search ..... 60/685, 687, 690, 692

[56] References Cited

U.S. PATENT DOCUMENTS 1,881,443 10/1932 Flanders ..... 60/687
2,356,721 8/1944 Hagemann ..... 60/687
4,206,013 6/1980 Dickey ..... 60/644
4,257,233 3/1981 Kaelber ..... 60/687

*Primary Examiner*—Allen M. Ostrager
*Assistant Examiner*—Stephen F. Husar
*Attorney, Agent, or Firm*—Burns, Doane, Swecker & Mathis

[57] ABSTRACT

The present invention relates to a supporting device for a condensation steam turbine. The turbine parts which are exposed to vacuum tension are attached to a foundation carrier. The foundation carrier is also integrated into a spring supported foundation. The foundation carrier may be connected to a substructure through a separate support. Alternately, a supporting structure may be used to support the foundation carrier and the spring supported foundation. A condenser itself may be constructed as a support.

5 Claims, 4 Drawing Figures

SUPPORTING DEVICE

BACKGROUND AND SUMMARY OF THE INVENTION

The present invention relates to a supporting device for a condensation steam turbine.

Various proposals have been made in order to control the great forces which a foundation for a steam turbine plant must absorb. These forces can lead to local bending and consequently can result in unacceptable displacements.

A supporting device which is known for an installation which comprises a condenser and a low-pressure outside turbine casing includes mounting the installation directly on a baseplate of a turbine foundation. The installation is secured both to the turbine foundation and to the baseplate by heat sensitive fixtures (See, for example, DE-OS No. 1,551,192).

This arrangement has the disadvantage that the entire turbine foundation is rigidly supported. Therefore, the turboset-foundation adjustment presents difficulties, particularly in the case of half-turning turbines.

It is an object of the present invention to avoid this disadvantage and to provide a support for both the condenser and the turbine parts subjected to vacuum tension.

It is a further object of the present invention to keep the displacements occuring from vacuum tension isolated from other turbine parts.

Still a further object of the present invention is to provide a rigid support structure for the turbine parts subjected to vacuum tension which is integrated within a spring-supported foundation for the remaining turbine parts. However, the rigid support structure does not interfere with the movement of the spring-supported structure.

The abovementioned objects and others are achieved according to the present invention by fastening the turbine parts which are exposed to the vacuum tension to a foundation carrier. The foundation carrier is connected through a support with a substructure. The foundation carrier is also integrated into a spring-supported foundation.

One advantage of the supporting device according to the present invention is that any displacement occasioned by vacuum tension will not appear on the spring-supported turbine parts. A further advantage of the present invention is derived from the fact that the condenser is fastened onto the floor and connected flexibly with the turbine. With such an arrangement, the condenser can be constructed without special installation measures and a spring-supported foundation for some of the turbine parts can be utilized.

According to a further embodiment of the present invention, the condenser itself is constructed as a support. According to this embodiment, no further supporting structures are required.

According to still a further embodiment, it has been found to be preferable for the foundation carrier to be supported on a supporting structure for the spring-supported foundation. A further advantage of this embodiment is that due to the step-like construction of the supporting structure of the spring-supported foundation, an additional support is not necessary for the turbine parts exposed to vacuum tension.

BRIEF DESCRIPTION OF THE DRAWINGS

Preferred embodiments of a supporting device according to the present invention will be described with reference to the accompanying drawings wherein like members bear like reference numerals and wherein.

DETAILED DESCRIPTION OF THE PREFERRED EMBODIMENTS

Figure 1:
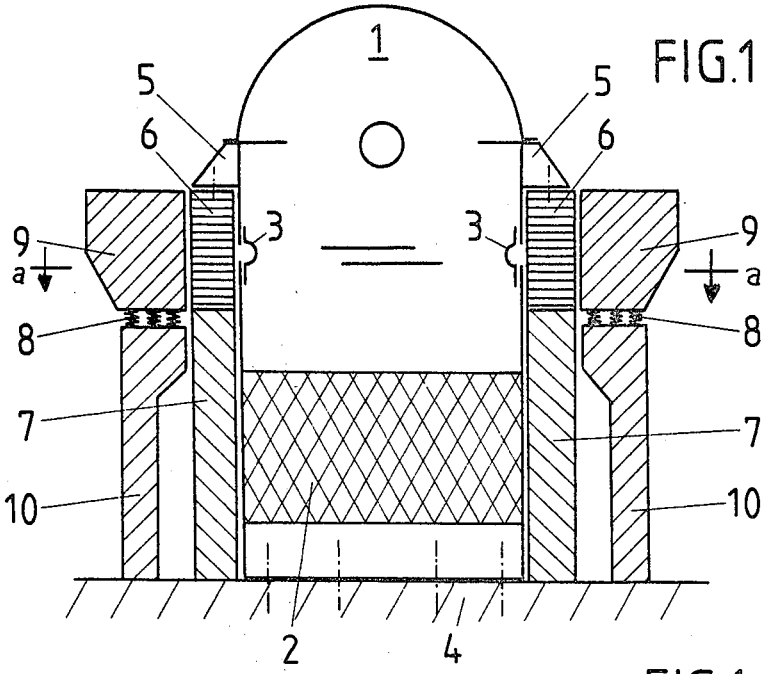
FIG. 1 is a cross sectional view through a supporting device according to the present invention.

With reference to FIG. 1, a turbine casing 1 is connected through one or a plurality of flexible connections 3 with a condenser 2. The condenser 2 is connected solidly with a substructure 4. The turbine casing 1, which is exposed to vacuum tension, is rigidly connected with the substructure 4 through a plurality of supporting arms 5 which arms rest upon a pair of foundation carriers or beams 6. Each foundation carrier or beam 6 rests on a respective support 7 attached to the substructure 4. The remaining turbine parts which are not exposed to the vacuum tension (for example, the bearing housing, not shown) are arranged on a foundation 9 which is supported on a supporting structure 10 through on a plurality of springs 8. In this way the foundation 9 is connected with the substructure 4 through the supporting structure 10.

Figure 1A:
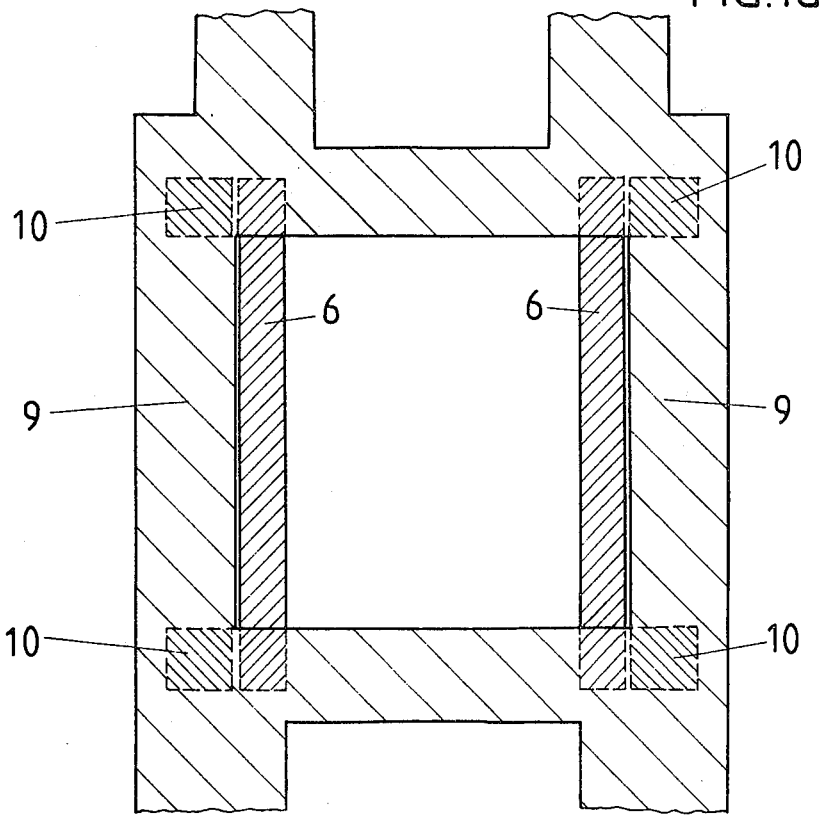
FIG. 1*a* is a top view of the supporting parts taken along the line a—a in FIG. 1 with the turbine casing removed.

The foundation 9 is preferably constructed as a frame so that the foundation carriers 6 can be arranged within the foundation 9 (see FIG. 1*a*). In such a frame-type construction, the ends of the foundation carriers 6 may be sloped so that they fit into correspondingly sloped recesses in the foundation 9. The foundation carriers 6, however, do not impede movement of the foundation 9 on the springs 8.

Figure 2:
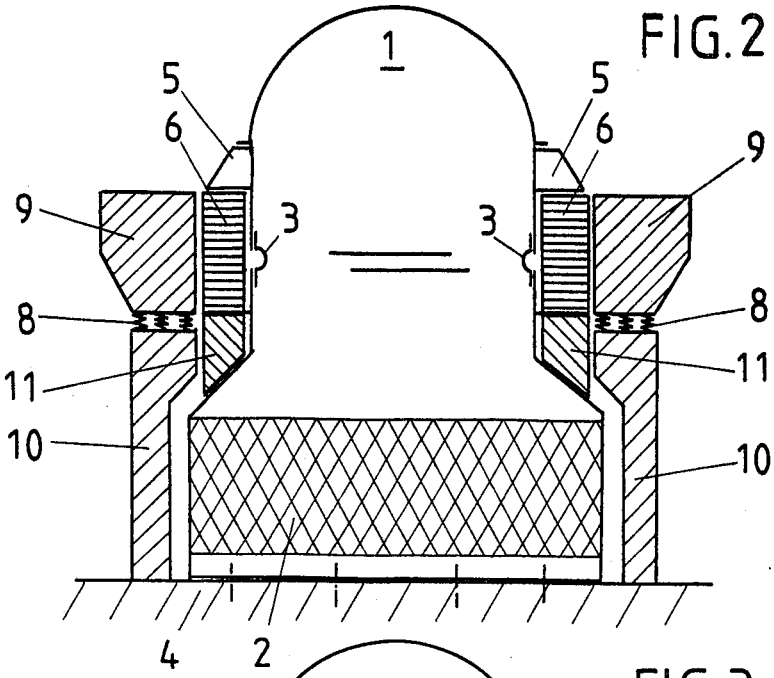
FIG. 2 is a cross sectional view through a second embodiment of a supporting device according to the present invention.

With reference now to FIG. 2, a second embodiment of the present invention is arranged with the condenser 2 constructed as a support. The foundation carriers or beams 6 include spacers 11 constructed similarly to the contour of the condenser 2. The spacers 11 are supported on the condenser 2. The construction of the foundation 9, the springs 8 and the supporting structure 10 is similar to that of the first embodiment as illustrated in FIG. 1.

Figure 3:
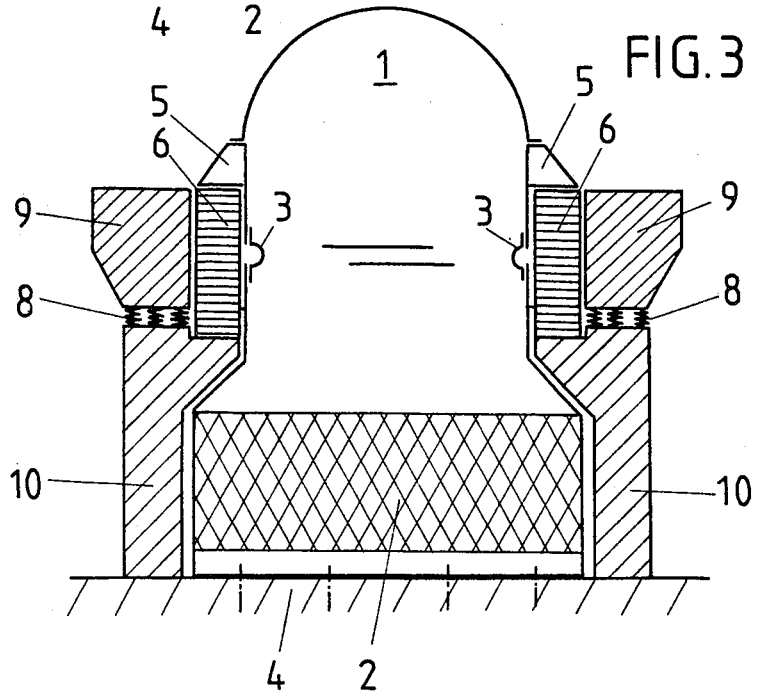
FIG. 3 is a cross sectional view through a third embodiment of a supporting device according to the present invention.

With reference now to FIG. 3, a third embodiment of a supporting device according to the present invention has the turbine casing 1, resting on the foundation carriers 6 through the supporting arms 5. In this embodiment, the foundation carriers or beams 6 are supported directly on the supporting structure 10. The spring properties of the foundation 9 are thereby not adversely affected.

The principles and preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by those skilled in the art without departing from the spirit of the present invention.

What is claimed is:

1. A supporting device for a condensation steam turbine having a condenser rigidly connected to a sub-structure and flexibly connected to a turbine casing, comprising:

a foundation carrier which supports only turbine parts exposed to vacuum tension;

a support which connects said foundation carrier with the sub-structure; and a spring supported foundation within which said foundation carrier is arranged, said foundation supporting the rest of the turbine.

2. The supporting device of claim 1 wherein the condenser also serves as said support which connects said foundation carrier with the sub-structure.

3. The supporting device of claim 1 further comprising:

a supporting structure on which said spring supported foundation rests.

4. The supporting device of claim 3 wherein said supporting structure is rigidly connected to the sub-structure.

5. The supporting device of claim 3 wherein said supporting structure serves as said support which connects said foundation carrier with the sub-structure.

* * * * *